United States Patent [19]

Foster

[11] 4,040,337

[45] Aug. 9, 1977

[54] MULTI-LOBE CAM FOR HYDRAULIC PISTON-AND-CYLINDER MACHINES

[75] Inventor: Kenneth William Samuel Foster, Prestbury, England

[73] Assignee: Renold Limited, Manchester, England

[21] Appl. No.: 581,694

[22] Filed: May 28, 1975

Related U.S. Application Data

[63] Continuation-in-part of Ser. No. 412,074, Nov. 2, 1973, abandoned.

[51] Int. Cl.[2] ..... F01B 13/06

[52] U.S. Cl. ..... 91/491

[58] Field of Search ..... 91/491-498; 92/58

[56] References Cited

U.S. PATENT DOCUMENTS

| | | | |
|---|---|---|---|
| 2,823,619 | 2/1958 | May | 92/58 |
| 3,046,950 | 7/1962 | Smith | 91/491 |
| 3,064,583 | 11/1962 | Burt | 417/219 |

FOREIGN PATENT DOCUMENTS

| | | | |
|---|---|---|---|
| 2,004,322 | 11/1971 | Germany | 91/491 |
| 718,372 | 11/1954 | United Kingdom | 90/58 |

*Primary Examiner*—William L. Freeh
*Attorney, Agent, or Firm*—Flynn & Frishauf

[57] ABSTRACT

A hydraulic motor having a multiple cam designed to provide a constant torque output at high load and low speed, taking into account torque dissipated in friction in the motor.

15 Claims, 7 Drawing Figures

MULTI-LOBE CAM FOR HYDRAULIC PISTON-AND-CYLINDER MACHINES

This application is a continuation-in-part application of my application Ser. No. 412,074 filed Nov. 2, 1973 now abandoned.

This invention relates to hydraulic piston-and-cylinder machines which may be pumps or motors.

In an hydraulic piston-and-cylinder machine, of the type (hereinafter called an hydraulic machine of the type described) using a multi lobe cam to control the displacement of the pistons or piston follower elements in the cylinder block with respect to the progression of the cylinder block along the direction of the cam, it is known to choose the number of cam lobes and number of pistons together with the geometry of the cam lobes in such a way that the sum of the piston velocities at any given instant is a constant.

This is a mathematical concept and its purpose (in for instance, slow speed motors) is to ensure that the instantaneous capacity of the motor to receive hydraulic fluid is constant at any angular position of its rotor. If the supply pressure of hydraulic fluid was also constant the theoretical output torque from a motor would be constant.

Stated another way, if the motor is supplied with a constant steady flow of hydraulic fluid and is subjected to a constant torque load, then a constant pressure of the fluid is required to overcome the torque load. That hydraulic piston-and-cylinder machines employing multiple pistons co-operating with multi-lobed cams have been designed to use these principles may be seen from a study of British patent specification No. 1,255,006.

There is a variety of different combinations of number of pistons to number of lobes and corresponding cam forms, which may be used, and the geometries of numbers of pistons to numbers of cam lobes has been well explored and discussed in British patent specification No. 1,255,006, and elsewhere.

A further characteristic of some of these geometries is that the number of pistons in communication with the high pressure port is the same as the number of pistons in communication with the low pressure port and that this number remains constant throughout the complete operating cycle. As example of this is a motor using four cam lobes with 16 pistons. In this case there are at all times eight pistons in communication with the high pressure port and eight pistons in communication with the low pressure port. When a set of four pistons is leaving the high pressure region a complementary set of four is leaving the low pressure region.

This characteristic is not a necessary part of the geometry required to achieve a mathematically constant torque. Other combinations of numbers of pistons to the numbers of lobes achieve mathematically constant torque, while having a varying number of pistons on high and low pressure. For example a motor having four cam lobes and six pistons has alternately two pistons on high pressure and four on low pressure and then four on high pressure and two on low pressure. When the cams for such motors are designed to achieve a mathematically constant torque, each half stroke (i.e. the inward or outward stroke) of each piston is divided in a number of phases for the purpose of the design. In general, these phases are as follows:

1. A dwell phase, i.e. zero velocity of the piston,

2. A piston acceleration phase,
3. A constant velocity phase of the piston,
4. A piston deceleration phase, and
5. A dwell phase, i.e. zero velocity of the piston.

The particular combination of number of pistons to number of lobes dictates which of these phases it is necessary to employ in designing the cam for a particular gepmetry of pistons and lobes and what proportion of each half stroke each phase should occupy. This is discussed in detail in British patent specification No. 1,255,006.

The concept of designing the cam so as to achieve a mathematically constant torque by providing a constant rate of displacement of hydraulic fluid in the cylinders, taken altogether, has been shown in practice to give improvements in torque performance superior to motors previously known. However, in the physical system, the effects of leakage past sealing clearances, compressibility of the fluid being used, friction, and discontinuities due to porting overlaps, all serve to modify the actual output torque to something less constant than might be wished.

In a slow speed motor these effects become particularly noticeable at very slow speed near maximum torque and in starting from rest under load. Under these conditions friction has a predominant effect on the actual output torque.

Thus, in an extreme example, under conditions where operation is required at maximum torque with 4000 lbs. per sq. inch fluid pressure and 2 r.p.m., the torque output can fluctuate widely. This is due, in the main, to the varying friction conditions within the motor, aggravated by varying conditions of compressibility and leakage of the hydraulic fluid in the motor.

It is an object of this invention to so modify the mathematical shape of the cam, in a machine of the type described, as to compensate at least in some degree for the effects of friction, and in so doing, achieve, for a motor, an output torque which in practice is more nearly constant at slow speeds so as to be superior to the constant displacement cam, and is no worse in terms of torque variation under normal running speeds.

This invention proposes that by accepting the existence of the friction losses on the output torque at the design state of the cam, the cam can be so designed, taking friction into account, to provide a theoretically frictionless torque output from fthe cam which varies in such a way that when the components of friction are subtracted from it, the resulting available torque at the output shaft is more nearly constant.

According to the invention, in a machine of the type described the cam is shaped so that for all points of operation, in the cycle of events constituting one torque producing cycle of the machine when the machine is operated as a motor, the mathematical output of the torque from the cam is constituted of two parts, first a component of the torque to provide the torque dissipated in friction in the motor while producing the output torque, and second a component of the torque required from that part of the cam being its contribution at that instant, to a constant torque output required at the motor shaft.

It will be understood that the second component is the major component of torque required from the cam at any instant.

The invention is more particularly applied to slow speed machines since it is at high load and low speed where the effect of friction losses is most noticeable.

The frictional torque at any point along the cam depends upon, the nature of the two contacting surfaces producing the frictional drag, the force pressing the two surfaces together and the effective moment of the frictional force produced about the centre of rotation of the cylinder block.

The invention may be applied to any hydraulic machine of the type described having a cam with a mathematically definable form but it is particularly useful where the effects of the friction produce an unacceptable deviation in torque whether it is by the output torque of the machine when the machine is operated as a motor or the input torque to the machine when the machine is operated as a pump.

Thus, according to the invention, as applied to a pump, the cam is shaped to provide for a constant torque input to the pump by designing the cam as if the pump is to be run as a motor having a constant torque output of the same amount.

A specific embodiment of this invention will hereinafter be described with reference to the accompanying drawings to show, by way of example, how the invention may be applied to an hydraulic machine of the type described comprising $2n$ lobes and $3n$ pistons.

Such a machine has a varying number of pistons on load at any one time and is subject to the greatest fluctuation of torque due to friction effects. This arises because torque is generated either by $n$ pressurized pistons acting or by $2n$ pressurized pistons acting. The total friction loss from the pistons is twice as great in the latter case, as compared with the former case, when twice as many pistons are acting. Therefore, the friction loss from the sources continuously varies in the ratio of 2:1.

Now, at very low speeds, friction values are relatively high, i.e. before an hydro-dynamic film of the hydraulic working fluid established itself between the various relatively moving surfaces. In a motor having a cam designed to achieve constant rate of displacement of the hydraulic fluid in the cylinders, taken altogether, and subjected to a constant torque load at very low speed, the internal friction variations effecting output torque call for a fluctuating pressure to overcome these changes. The fluctuating pressure demand to overcome the constant torque load results in fluctuating leakage internally within the motor and also fluctuating hydraulic fluid flow due to the system compressibility. The result is a speed variation and a torque variation known as "cogging".

In the embodiment of the invention which is about to be described, the machine is a radial piston and cylinder machine. At slow speed pressure fluctuations are reduced. The cam is modified from a theoretical shape which achieves a constant rate of displacement of the hydraulic fluid, so as to take account of friction losses, thereby to achieve a net output torque which is more nearly constant under slow speed, high load conditions.

Figure 1:
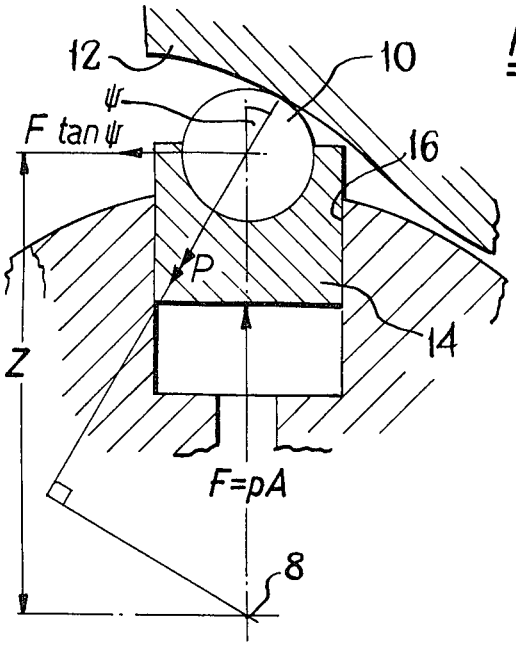
FIGS. 1 to 4 are diagrammatic representations showing one of the pistons, its piston follower element, part of the cylinder block, and part of the multi-lobe cam, with the piston occupying different positions throughout its stroke.

Referring to the accompanying drawings the machine is an hydraulic piston and cylinder motor as described in detail in the Applicants' co-pending patent applications Ser. Nos. 304,838 and 304,748.

According to this invention the multi-lobe cam of the motor is shaped so that for all points of operation, in the cycle of events constituting one torque producing cycle of the motor, the mathematical output of the torque from the cam is constituted of two parts, first a component of the torque to provide the torque dissipated in friction in the motor while producing the output torque, and second a component of the torque from that part of the cam being its contribution at that instant to the constant torque output required at the motor shaft.

$$\text{The output torque of the motor} = T_t \times \eta$$

Where $T_t$ = theoretical torque and $\eta$ = torque efficiency

Now leakage and compressibility of the hydraulic fluid will have a greater effect on the output speed than on output torque of the motor but pressure transients due to the compressibility of the small isolated volumes of fluid under the pistons during porting transfer will impose transient irregularities on the torque output.

Friction has a direct effect on torque and only an indirect effect on speed because of the changes in leakage and compressibility consequent on the change in pressure due to a loss of torque from friction.

It is reasonable therefore to seek to represent the torque efficiency in terms of frictional variations and losses.

As diagrammatically indicated in FIGS. 1 to 4 where the centre of rotation of the rotor forming the cylinder block is at 8 and in which the roller follower 10 of the multi-lobe cam 12 imparts reciprocating motion to the piston 14, two principal frictional contacts are evident (1) between the follower 10 and the piston 14, ($\mu_1$), and (2) between the piston 14 and its cylinder bore 16 ($\mu_2$).

It can be shown for this case that the torque efficiency can be represented in the form:

$$\eta = \frac{1 - \mu_1 f_1 (Z, \frac{dZ}{d\theta}, \theta)}{1 + \mu_2 k_f (Z, \frac{dZ}{d\theta}, \theta)}$$

Where $Z$ = positional radius of the follower from the centre 8 of the rotor as shown in FIG. 1

$f_1$ ($Z$, $dZ/d\theta$, $\theta$) is a mathematical function of $Z$, $dZ/d\theta$, and $\theta$, and $f_2$ ($Z$, $dZ/d\theta$, $\theta$) is a mathematical function of $Z$, $dZ/d\theta$, and $\theta$.

The theoretical torque $T_t$ contributed by each piston 14 about the centre 8 when a working fluid pressure $p$ acts on a piston area A, giving rise to a force $F = pA$, is equal to $$T_t = FZ \tan \psi \qquad (1)$$

$\psi$ = cam/follower contact angle as shown in FIG. 1.

Figure 2:
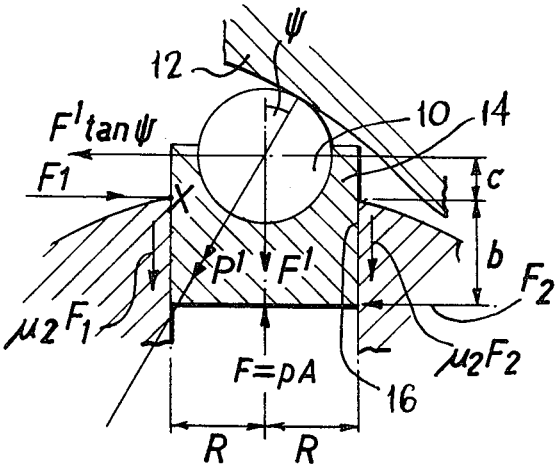

With reference to FIG. 2, which shows the piston partly in and partly out of the cylinder bore, it can be shown by resolving forces and taking moments, that the available torqu $T^1$ remaining after accounting for the friction contact $\mu_2$ between the piston 14 and its cylinder bore 16 is:

$$T^1 = \frac{FZ \tan \psi}{1 + \mu_2 \tan\psi \left(1 + \frac{2a^1}{b^1}\right)} \quad (2)$$

Where $a^1 = c + \mu_2 R$ $b^1 = b$ $R$ = piston radius and $b$ and $c$ are the lengths of the piston portions indicated respectively $b$ and $c$ in FIG. 2.

Figure 3:
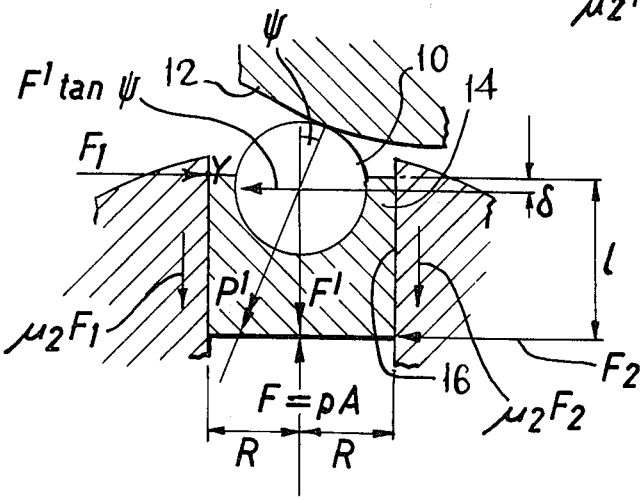

This is a general form and with reference to FIG. 3, which shows the piston fully in the cylinder bore, it may be shown in the same way that the expression reduces to $$T^1 = \frac{FZ \tan \psi}{1 + \mu_2 \tan \psi \left(\frac{1 + {}^2(\mu_2 R - \delta)}{l}\right)} \quad (3)$$

Where $l$ is the overall length of the piston and $\delta$ is the length of the piston above the centre of the roller follower.

In the piston configuration shown in FIGS. 2 and 3, friction also occurs between the roller follower 10 and its seat in the top of the piston 14.

Figure 4:
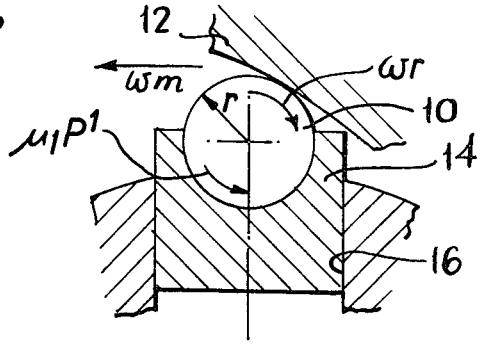

With reference to FIG. 4, it can be shown, by equating power, that the net loss of torque $t$ due to this roller follower friction alone is equal to:

$$t = \mu_1 \frac{P^1 (Z + r \cos \psi)}{\cos \psi} \quad (4)$$

Where $P^1$ = normal reaction force acting on a roller and $r$ = radius of the roller follower.

Therefore, the net torque available after subtracting the torque absorbed in overcoming the friction of the piston in its bore and the roller follower friction is equal to $$T^{11} = T^1 - t \quad (5)$$

$$\therefore T^{11} = FZ \tan \psi \left[\frac{1 - \frac{\mu_1 (Z + r \cos \psi)}{Z \sin \psi \cos \psi}}{1 + \mu_2 \tan \psi \left(1 + \frac{2a^1}{b^1}\right)}\right]$$

The term outside the bracket in equation (5) is the theoretical torque $T_t$ contributed by the piston disregarding the effects of friction. It is the theoretical torque for a frictionless piston 14 and follower 10. The term in the brackets in equation (5) is the torque efficiency 7. This is always less than 1 for values of $\mu_1$ and $\mu_2$ greater than zero.

The torque output from the piston may thus be expressed:

$$T = FZ \tan \psi \, \eta$$

$$T = F \frac{dz}{d\theta} \eta \quad (6)$$

Dividing by F gives a term which will be called "the effective radial velocity" V of the piston, since its value is a measure of the available torque for an applied cylinder pressure $p$ to do work after the effects of the bore and roller follower friction associated with the piston have been overcome.

$$\therefore V = \frac{dz}{d\theta} \eta \quad (7)$$

OR $$\frac{dz}{d\theta} = V \frac{1 + \mu_2 f_2 (Z, \frac{dz}{d\theta}, \theta)}{1 - \mu_2 f_1 (Z, \frac{dz}{d\theta}, \theta)} \quad (8)$$

Where $f_1 (Z, dz/d\theta, \theta)$ and $f_2 (Z, dz/d\theta, \theta)$ are functions depending upon the particular piston and follower geometry.

The torque efficiency as expressed in equation (5) may be simplified within the permitted limits of accuracy in a practical design by employing a number of simplifying assumptions involving substitutions as follows:

(i) $\cos\psi = \sqrt{\alpha}$ (ii) $\cos\psi \sin \psi = \tan \psi$ (iii) $\left(1 + \frac{2a}{b}\right) = KZ$ Where $K$ and $\alpha$ are approximation constants.

Thus, equation (8) becomes $$\frac{dz}{d\theta} = \frac{V_A + \frac{\mu_1}{\alpha} (Z + R\sqrt{\alpha})}{1 - \mu_2 K V_A} \quad (9)$$

Where $V_A$ = the approximate "Effective Radial Velocity" of the piston, i.e. the approximate available torque for an applied cylinder pressure $p$ to do work after the affects of the bore and roller follower friction associated with the piston have been overcome.

Less error in the approximation of equation (9) is involved if, instead of using a mean constant value for K, the value of this constant is varied throughout the calculations in accordance with its readily computed variation with Z. K is dependent upon the particular piston to bore geometry and varies also with the position of the piston within the bore for the geometry shown in FIGS. 1 and 2.

Equations (8) and (9) are valid at any relative angular position of the piston and cam within the limits of the simplifying assumptions set out above.

The hydraulic machine under consideration is assumed to have six pistons and four cam lobes.

Each lobe of the cam is divided into a power stroke occupied by the outward stroke of each piston, and a return stroke occupied by the inward stroke of each piston.

Figure 5:
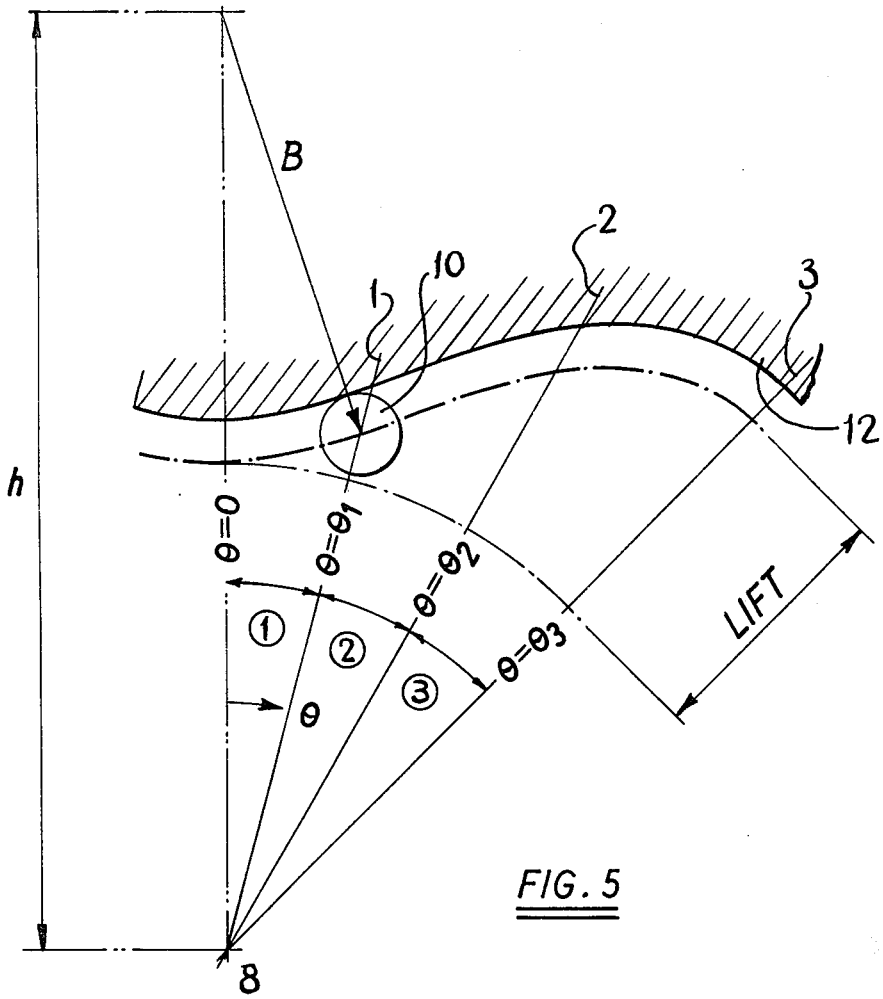
FIG. 5 is a diagram showing the approximate form of the cam.

The form of the cam for the outward stroke of each piston is the mirror image of the form of the cam for the inward stroke of the piston to ensure that the hydraulic machine is reversible by changing over its inlet and outlet ports. In other words, the cam form in FIG. 5 is symmetrical with respect to the axis 3. Considering then the outward stroke only, assume that the number of pistons and the number of cam lobes has been chosen to give balanced radial forces where this is considered desirable and also that the phases of the stroke devoted to acceleration, deceleration and so on of the piston have been chosen in accordance with the particular geometry as in prior art designs which provide for a constant rate of displacement of hydraulic fluid in the cylinders, taken all together, the design of the cam according to the principles of the present invention proceeds as follows:

The first acceleration phase of the cam is chosen to have a convenient form. If one follows standard engineering machine design practice, then this phase of the cam will be made to one of a number of known shapes. In the present example it is assumed that a simple circular arc is chosen, since this is an easily definable form, and will give a favourable contact stress condition for the roller followers 10.

The design approach being described is applicable to any geometry of pistons and cam lobes in a machine of the kind described but is restricted to the particular case selected, i.e. a machine having six pistons and four cam lobes. Accordingly, a zero dwell phase at the beginning and at the end of the outward stroke is assumed. Therefore, the lift of the follower 10 (see FIG. 5) for the outward stroke must occupy an angle of 45° of rotation of the cylinder block. This may be divided into an initial acceleration phase of 15° rotation, a final deceleration phase of 15° rotation and an intermediate phase of 15° of rotation to be determined. Thus, the three phases 1, 2 and 3 are of equal angular duration.

In FIG. 5 the initial 15° has a circular arc form having a radius B for which $$Z_1(\theta) = H\cos\theta - \sqrt{B^2 - h^2\sin^2\theta} \qquad (10)$$

Where $h$ = the radial distance of the centre of the arc from the centre 8.

This equation can be differentiated to give $dz/d\theta = Z^1\mathbf{1}(\theta)$ and substituted in equation (8) along with the contact angle $\psi$ and the other required information to give V between $\theta = 0°$ and $\theta = 15°$.

Alternatively, equation (9) may be used to give a close approximate solution.

The actual result will depend on the values of $\mu_1$ and $\mu_2$ which are taken. These values may either be assumed from a knowledge of the materials chosen to comprise the pistons and the cylinder block and so on, or established by prior experiment.

As a practical guide $\mu_1$ may lie between 0.001 and 0.200 and $\mu_2$ between 0.02 and 0.300 for the geometry of the present example. For a given geometry the values of $\mu_1$ and $\mu_2$ are likely to vary with the relative surface velocities and the hydraulic working fluid being used.

Having determined $V_1$ from equation (8) (or $VA_1$ if the approximate equation (9) is used) over the initial acceleration phase of the cam from $\theta = 0$ to $\theta = \theta_1$, the intermediate phase $\theta = \theta_1$ to $\theta = \theta_2$ has to be determined such that $$V_2(\theta)\theta_1^{\theta_2}$$

is equal to $V_1(\theta = \theta_1)$ for the duration of the intermediate phase. Equation (8) is still applicable to determine $$Z_1\frac{dz}{d\theta}$$

and $\psi$, letting $V = V_2 =$ constant.

It may be preferred here to adopt a step-by-step technique using a digital computer.

Using equation (9) however, an analytical solution is possible, taking account of the physical continuity of the cam which is necessary across the boundary between the first and intermediate phases of the cam.

At the end of the intermediate phase, for $\theta = \theta_2$, $Z_2$, $dz_1/d\theta$ and $\psi$ are known.

The condition that $$V_3(\theta) = V_2 - V_1(\theta - \theta_2) \qquad (11)$$

needs to be fulfilled for the final phase of the cam from $\theta = \theta_2$ to $\theta = \theta_3$ also that $$Z_2(\theta = \theta_2) = Z_3(\theta = \theta_2) \qquad (12)$$

and $$\frac{dz}{d\theta} \text{ at } \theta = \theta_2 \text{ is continuous.} \qquad (13)$$

The first and last of these requirements (11) and (13) are in conflict because at $\theta - \theta_2 = 0$, $dz_1/d\theta = 0$ but $V \neq 0$. V is negative, i.e. friction loss is occurring at a point where torque production has not commenced. This condition persists until the torque generated by the piston as it commences its power stroke equals that being consumed in friction.

Since it is clear that the last requirement is a physical necessity, the transient conflict at $\theta_2$ is best circumvented by setting $V_1 = 0$ for all negative values of $V_1$.

A similar transient anomaly occurs at the end of the final phase of the cam when $\theta = \theta_3$. In order that $V_3$ shall become zero at $\theta = \theta_3$, $dz/d\theta$ must still be positive but the physical requirements of having to produce a mirror image of the first half of the cam lobe following directly upon the final phase of the outward stroke of the piston demands that for the roller follower to traverse the junction of the two halves of the cam lobe smoothly at $\theta = \theta_3$, $dz/d\theta$ must also equal zero.

Since for normal values of friction, $dz/d\theta$ at $\theta = \theta_3$ will be small, an acceptable solution here is to introduce an arbitrary blend radius over the last few degrees as $\theta$ approaches $\theta_3$ which makes $dz/d\theta = 0$.

Using either equation (8) or equation (9), an analytical solution of the final phase becomes difficult and it is better to proceed by way of successive approximations or by using step by step techniques on a digital computer.

The following cam co-ordinates set out in the first four columns of the TABLE in terms of angle $\theta$ and the positional radius of the follower Z, relate to the specific example and define the line traced by the centre of the roller follower 10 in FIG. 5 starting from the inner dead centre position $\theta = 0$. The TABLE shows the positional radius $Z_1$, $Z_2$, $Z_3$ calculated for the three phases 1, 2 and 3 in FIG. 5 for angular increments of one half degree up to 15° as set out in the first column of the TABLE. It will be appreciated that with the specific values set out in the first four columns of the TABLE, the cam lobe shape in FIG. 5, for the outward stroke of each piston, may be plotted, assuming a suitable value for the radius of the roller follower 10. The cam lobe shape for the inward stroke is a mirror image of the shape for the outward stroke. The calculation was started by choosing values for $h$ and B from a knowledge of the geometrical constants of the design, and by assuming that Z will change between $\theta = 0$ and $\theta = 15°$ by approximately 24% of the lift. Therefore $$Z_1 \simeq Z_0 + 0.24 \text{ lift}$$

Hence, B from equation (10) was estimated. The previously computer programmed calculations were then completed to give a time value for the lift and the programme was rerun until with suitably amended values of B the required lift was achieved.

Figure 6:
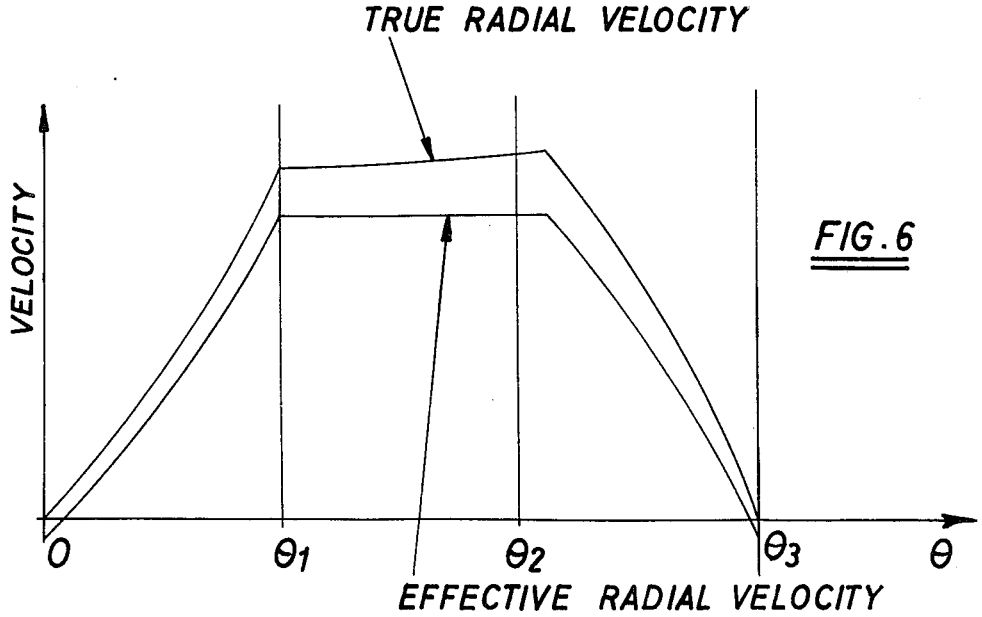
FIG. 6 is a diagram comparing the true radial velocity and the effective radical velocity of the piston for its outwards stroke.

The values set out in the last three columns of the TABLE are the true radial velocities of the piston at the various coordinates such as is set out in FIG. 6.

| ANGLE° | $Z_1$ | $Z_2$ | $Z_3$ | $\frac{dz1}{d\theta}$ | $\frac{dz2}{d\theta}$ | $\frac{dz3}{d\theta}$ |
|---|---|---|---|---|---|---|
| .0 | 1.00000 | 1.05574 | 1.17490 | 0.00000 | 0.45411 | 0.45624 |
| .5 | 1.00006 | 1.05970 | 1.17889 | 0.01332 | 0.45418 | 0.45631 |
| 1.0 | 1.00023 | 1.06367 | 1.18287 | 0.02666 | 0.45425 | 0.45192 |
| 1.5 | 1.00052 | 1.06763 | 1.18675 | 0.04002 | 0.45433 | 0.43791 |
| 2.0 | 1.00093 | 1.07159 | 1.19051 | 0.05341 | 0.45440 | 0.42392 |
| 2.5 | 1.00146 | 1.07556 | 1.19416 | 0.06684 | 0.45447 | 0.40992 |
| 3.0 | 1.00210 | 1.07953 | 1.19768 | 0.08032 | 0.45454 | 0.39592 |
| 3.5 | 1.00286 | 1.08349 | 1.20108 | 0.09388 | 0.45461 | 0.38191 |
| 4.0 | 1.00374 | 1.08746 | 1.20435 | 0.10751 | 0.45468 | 0.36786 |
| 4.5 | 1.00473 | 1.09143 | 1.20751 | 1.12122 | 0.45475 | 0.35377 |
| 5.0 | 1.00585 | 1.09540 | 1.21054 | 0.13504 | 0.45482 | 0.33964 |
| 5.5 | 1.00709 | 1.09937 | 1.21345 | 0.14897 | 0.45489 | 0.32543 |
| 6.0 | 1.00845 | 1.10334 | 1.21624 | 0.16342 | 0.45497 | 0.31116 |
| 6.5 | 1.00994 | 1.10731 | 1.21890 | 0.17721 | 0.45504 | 0.29679 |
| 7.0 | 1.01155 | 1.11128 | 1.22143 | 0.19155 | 0.45511 | 0.28233 |
| 7.5 | 1.01328 | 1.11525 | 1.22384 | 0.20605 | 0.45518 | 0.26776 |
| 8.0 | 1.01514 | 1.11922 | 1.22613 | 0.22073 | 0.45525 | 0.25307 |
| 8.5 | 1.01713 | 1.12320 | 1.22828 | 0.23560 | 0.45532 | 0.23823 |
| 9.0 | 1.01926 | 1.12717 | 1.23030 | 0.25068 | 0.45539 | 0.22326 |
| 9.5 | 1.02151 | 1.13114 | 1.23220 | 0.26598 | 0.45546 | 0.20811 |
| 10.0 | 1.02390 | 1.13512 | 1.23396 | 0.28151 | 0.45553 | 0.19280 |
| 10.5 | 1.02642 | 1.13910 | 1.23558 | 0.29730 | 0.45568 | 0.17729 |
| 11.0 | 1.02909 | 1.14307 | 1.23707 | 0.31337 | 0.45568 | 0.16158 |
| 11.5 | 1.03189 | 1.14705 | 1.23843 | 0.32972 | 0.45575 | 0.14565 |
| 12.0 | 1.03484 | 1.15103 | 1.23964 | 0.34639 | 0.45582 | 0.12948 |
| 12.5 | 1.03794 | 1.15500 | 1.24071 | 0.36338 | 0.45589 | 0.11307 |
| 13.0 | 1.04119 | 1.15898 | 1.24163 | 0.38073 | 0.45596 | 0.09638 |
| 13.5 | 1.04459 | 1.16296 | 1.24241 | 0.39845 | 0.45603 | 0.07941 |
| 14.0 | 1.04814 | 1.16694 | 1.24299 | 0.41657 | 0.45610 | 0.05291 |
| 14.5 | 1.05186 | 1.17092 | 1.24334 | 0.43512 | 0.45617 | 0.02644 |
| 15.0 | 1.05574 | 1.17490 | 1.24345 | 0.45411 | 0.45624 | 0.00000 |

FIG. 6 is a typical velocity diagram for one piston of the present design drawn to an exaggerated scale and illustrating the difference between the true radial velocity and the effective radial velocity of the piston. It will be noted that in the intermediate phase the effective radial velocity of the piston is constant and the true radial velocity steadily increases as may be seen from the velocity co-ordinates set out in the sixth column of the TABLE.

Figure 7:
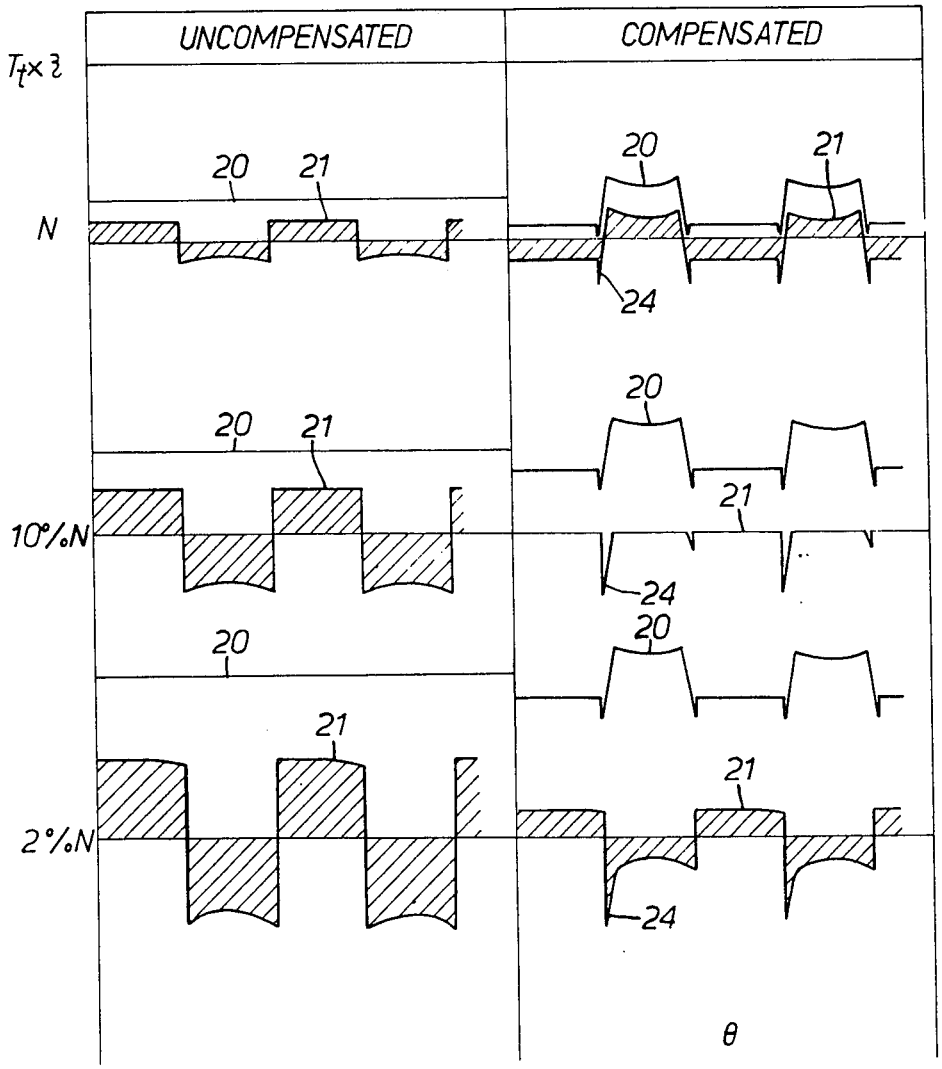
FIG. 7 are graphs comparing theoretical torque variations for a typical motor at very slow speed and normal speed with uncompensated cam forms and cam forms compensated in accordance with this invention.

If the velocity profiles of pistons following this cam in the motor are drawn in true relation to one another on a base of angular displacement, then the graphical sum of these profiles would give a line such as the lines 20 in FIG. 7 which can be shown to be proportional to the theoretical torque produced. Associated with each velocity profile will be a second profile similar in form but deviating from the first form by an amount proportional to the friction torque loss at that point. The graphical sum of this second profile indicated by the lines 21 in FIG. 7 will be proportional to the remaining torque available at the output shaft. In accordance with the principles of this invention a cam is provided which allows this second considered torque to be more nearly constant in a practical motor than previous cam forms as shown by comparison on the left and right hand sides respectively of FIG. 7.

The effective torque produced (sum of the effective radial velocities) will have a sharp spike 24 of reduced torque for a short interval coinciding with the transition at $\theta = \theta_2$. In practice this torque spike will be less severe due to the effect of compressibility and porting characteristics during the first few degrees of load cycle.

An exactly similar effect is seen at $\theta = \theta_3$.

Although in the specific embodiment, each half of each cam lobe has been assumed to have three phases only, it will be well understood by those skilled in the art, that the same principles and general equations evolved in this specification may be employed to design a cam in accordance with this invention with only two phases, or more than three phases as hereinbefore described to compose each half lobe of the cam. Also, if reversability is not required, the cam half lobes may be independently designed using the same principles and general equations.

Now the torque efficiency of the type of motor being considered in this example will vary with speed, being worst to start and improving with increasing speed to some maximum value around its optimum working speed. It is consequently not possible to choose single values of $\mu_1$ and $\mu_2$ to give a constant output torque over the whole of the speed and load range of a normal motor design. It can be shown, however, that with suitably chosen values the torque fluctuation at very slow speed can be drastically reduced with the fluctuation at higher speeds (where there is no problem from this torque fluctuation) being no worse than with an uncompensated cam, the net result being a motor capable of operating smoothly under load at slower speeds than it would be capable of with an uncompensated cam form. This is illustrated in the graphs in FIG. 7, and follows from a consideration of equation (8). For a given cam design, $Z, dz/d\theta$ and $\theta$ are defined. The value of V therefore depends on the governing values of $\mu_1$ and $\mu_2$ and these vary over the operating range. An operating point must therefore be chosen, i.e. for which values of $\mu_1$ and $\mu_2$ the cam is to be designed. When the motor is operated away from the design point the torque at the output shaft of the motor again becomes less constant.

The torque at slow speeds can however be made more constant at slow speeds using the principles of the present invention.

In accordance with those principles, the sum of the effective radial velocities (as hereinbefore defined) of all the pistons is constant, for all those angular positions of the cylinder block relative to the cam except in the transition zones between the cam phases. Here, because of the physical continuity requirements necessary to allow smooth transition of the roller followers from one cam phase to the next, the sum of the effective radial velocities must change momentarily from the normal constant value.

An hydraulic machine in accordance with the present invention is distinguished from prior art machines having a cam designed in accordance with the principles discussed in British Pat. No. 1,255,006 in which the sum of the actual radial velocities of all the pistons is constant for all angular positions of the cylinder block relative to the cam. In an hydraulic machine in accordance with the present invention the sum of the actual velocities of the pistons will be seen by measurement of the cam and piston and cylinder assemblage to be variable. Also, it will be seen that the machine does not have a constant rate of displacement of working fluid as do the prior art machines designed to provide a theoretical constant output torque without regard to friction losses.

I claim:

1. An hydraulic piston and cylinder machine having a given speed range, comprising a cylinder block defining a plurality of cylinders, a plurality of pistons slidably mounted in respective cylinders, piston follower elements associated with said pistons, means for supplying fluid to and for venting fluid from said cylinders, a multi-lobe cam to control the displacement of the pistons and piston follower elements in the cylinder block with respect to the progression of the cylinder block along the direction of the cam, and a drive shaft when the machine is operated as a motor, the cam being shaped to provide a constant output torque at the motor drive shaft at an intermediate speed in said given speed range of the machine and so that all points of operation, in the cycle of events constituting each constant torque producing cycle of the machine, the mathematical output of the torque from the cam comprises two parts, the first part being a component of the torque to provide the torque dissipated in friction between the pistons and piston follower elements on the one hand and the pistons and cylinders on the other hand in the motor while producing the output torque, and the second part being a component of the torque required from that part of the cam being its contribution at that instant to said constant torque output required at the motor drive shaft, and the sum of the velocities of all the pistons varies from point to point.

2. A machine as claimed in claim 1 comprising $3n$ pistons, and wherein said cam has $2n$ lobes and a cam shape modified to provide said first part of the mathematical output of the torque from a shape providing said second part of the mathematical output of the torque in which the cam form for an outward stroke of each piston is the mirror image of the cam form for the inward stroke of each piston.

3. A machine as claimed in claim 2 wherein said cam shape is modified from a shape providing said second part of the mathematical output of the torque in which the cam form for an outward stroke of each piston is of angular duration $\pi/2n$ and is made up of a first section giving a period of acceleration covering the first third of the angular duration of stroke, a third section giving a period of deceleration covering the third third of the angular duration of stroke, and a centre section which is a modified constant velocity curve, the modified cam shape having a first section of constant radius.

4. A machine as claimed in claim 3 wherein the modified cam shape has a continuous transition of velocity between said centre section and said third section.

5. A machine as claimed in claim 4 wherein the modified cam shape has a velocity discontinuity between said third section and its mirror image section starting the next cam lobe, said discontinuity being smoothed with a suitable radius.

6. An hydraulic piston-and-cylinder machine having a given speed range comprising a cylinder block defining a plurality of cylinders, a plurality of pistons slidably mounted in respective cylinders, means for supplying fluid to and for venting fluid from said cylinders, a multi-lobe cam to control the displacement of the pistons in the cylinder block with respect to the progression of the cylinder block along the direction of the cam, and a drive shaft when the machine is operated as a motor, the cam being shaped to provide a constant output torque at the motor drive shaft at an intermediate speed in said given speed range of the machine such that for all points of operation, in the cycle of events constituting each constant torque producing cycle of the machine, the mathematical output of the torque from the cam comprises two parts, the first part being a component of the torque to provide the torque dissipated in friction in the motor while producing the output torque, and the second part being a component of the torque required from that part of the cam being its contribution at that instant to said constant torque output required at the motor drive shaft, and such that, in the cycle of events constituting each constant torque producing cycle of the machine, the sum of the effective piston velocities of all the pistons at any given instant of operation of the machine is constant and defined by $$\Sigma V = \Sigma \frac{dz}{d\theta} \eta,$$

ignoring any transition zones of the cam lobes between phases thereof to smooth the transition of the pistons from each cam phase to the next.

7. An hydraulic piston and cylinder machine according to claim 6 comprising piston follower elements associated with and coupled to respective pistons, said multi-lobe cam controlling the displacement of said piston follower elements to thereby control the displacement of said pistons.

8. An hydraulic piston-and-cylinder machine as claimed in claim 6 wherein 7 is of the form $$\eta = \left[ \frac{1 - \mu_1 f_1\left(Z, \frac{dz}{d\theta}, \theta\right)}{1 + \mu_2 f_2\left(Z, \frac{dz}{d\theta}, \theta\right)} \right].$$

9. An hydraulic piston-and-cylinder machine as claimed in claim 8 wherein $$\frac{dz}{d\theta} = \frac{V_A + \frac{\mu_1}{\alpha}(Z + r\sqrt{\alpha})}{1 - \mu_2 K V_A}.$$

10. An hydraulic machine as claimed in claim 6 wherein each cam lobe defines an outward stroke of each piston made up of an acceleration phase followed by a deceleration phase.

11. An hydraulic machine as claimed in claim 10 wherein the lobe defines a dwell phase prior to the outward stroke and defines a dwell phase at the end of the outward stroke.

12. An hydraulic piston-and-cylinder machine as claimed in claim 10 having $4n$ pistons and $n$ cam lobes.

13. An hydraulic piston-and-cylinder machine as claimed in claim 6 wherein each cam lobe defines an outward stroke of each piston made up of a relatively high acceleration phase followed by a relatively low acceleration phase followed by a deceleration phase.

14. An hydraulic piston-and-cylinder machine as claimed in claim 13 having $3n$ pistons and $2n$ cam lobes.

15. A method of operating an hydraulic piston-and-cylinder motor within a given speed range, the motor being of the type comprising a cylinder block defining a plurality of cylinders, a plurality of pistons slidably mounted in respective cylinders, piston follower elements associated with said pistons, means for supplying fluid to and for venting fluid from said cylinders, a motor output shaft, and a multi-lobe cam to control the displacement of the pistons and piston follower elements in the cylinder block with respect to the progression of the cylinder block along the direction of the cam in order to obtain a constant torque output at the motor output shaft at an intermediate speed in said given speed range, the method comprising:

operating said motor at said intermediate speed and for all points of operation in the cycle of events constituting each constant torque producing cycle of the motor, providing a mathematical output of torque from the cam which comprises two parts, the first part being a component of torque equal to the torque dissipated in friction in the motor while producing the output torque, said first torque component providing the torque dissipated in friction between the pistons and piston follower elements on the one hand and the pistons and the cylinders on the other hand and the second part being a component of torque required from that part of the cam being its contribution at that instant to the constant torque output required at the motor output shaft, the sum of the velocities of all the pistons being varied from point to point.

* * * * *

UNITED STATES PATENT AND TRADEMARK OFFICE

CERTIFICATE OF CORRECTION

PATENT NO. : 4,040,337

DATED : August 9, 1977

INVENTOR(S) : Kenneth W.S. FOSTER

It is certified that error appears in the above-identified patent and that said Letters Patent are hereby corrected as shown below:

Column 12, line 49, after "wherein", change "7" to --η--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*